US010062939B2

(12) United States Patent
Liu et al.

(10) Patent No.: US 10,062,939 B2
(45) Date of Patent: Aug. 28, 2018

(54) PHASE SHIFTER OF THE CAVITY TYPE INCLUDING A FEEDING NETWORK, A SLIDEABLE DIELECTRIC ELEMENT AND A TRANSFORMATION DEVICE, WHICH ARE MOUNTED WITHIN THE CAVITY OF THE PHASE SHIFTER

(71) Applicant: Comba Telecom Technology (Guangzhou) Ltd., Guangdong Province (CN)

(72) Inventors: Peitao Liu, Guangdong Province (CN); Guosheng Su, Guangdong Province (CN); Litao Chen, Guangdong Province (CN); Binlong Bu, Guangdong Province (CN); Fengzhang Xue, Guangdong Province (CN); Shanqiu Sun, Guangdong Province (CN)

( * ) Notice: Subject to any disclaimer, the term of this patent is extended or adjusted under 35 U.S.C. 154(b) by 0 days.

(21) Appl. No.: 15/114,154

(22) PCT Filed: Jan. 27, 2015

(86) PCT No.: PCT/CN2015/071661
§ 371 (c)(1),
(2) Date: Jul. 26, 2016

(87) PCT Pub. No.: WO2015/113489
PCT Pub. Date: Aug. 6, 2015

(65) Prior Publication Data

US 2016/0372809 A1 Dec. 22, 2016

(30) Foreign Application Priority Data

Jan. 28, 2014 (CN) ..... 2014 1 0042992

(51) Int. Cl.
*H01P 1/18* (2006.01)
*H01Q 3/32* (2006.01)
(Continued)

(52) U.S. Cl.
CPC ..... *H01P 1/184* (2013.01); *H01P 1/182* (2013.01); *H01P 1/207* (2013.01); *H01P 5/182* (2013.01); *H01Q 3/30* (2013.01); *H01Q 3/32* (2013.01)

(58) Field of Classification Search
CPC ..... H01P 1/184; H01P 1/18; H01P 9/00
(Continued)

(56) References Cited

U.S. PATENT DOCUMENTS 3,440,573 A * 4/1969 Butler ..... H01P 1/183 333/156
5,905,462 A * 5/1999 Hampel et al. ..... H01Q 3/26 333/159

FOREIGN PATENT DOCUMENTS

CN 201616495 10/2010
CN 202817199 3/2013
(Continued)

*Primary Examiner* — Benny Lee
(74) *Attorney, Agent, or Firm* — John W. Powell; Verrill Dana, LLP

(57) ABSTRACT

A phase shifter of cavity type includes an integrally formed cavity, a feeding network disposed inside the cavity, a dielectric element disposed between the feeding network and the cavity, and at least one transmission-line transformation device. The at least one transmission-line transformation device is connected with the cavity by welding for connecting an outer conductor of a transmission cable, and for passing an inner conductor of the transmission cable into the cavity and being connected with the feeding network. Phase shifting is achieved by straight movement of the dielectric element along the longitudinal direction of the cavity. For the phase shifter of cavity type, the cavity and
(Continued)

transmission-line transformation device are individually designed, and as a result, difficulty in design and manufacture is decreased. In addition, fasteners such as screws are not used for securing the phase shifter, thus avoiding reliability and inter-modulation problems resulted from failure of screws.

7 Claims, 3 Drawing Sheets

(51) Int. Cl.
*H01Q 3/30* (2006.01)
*H01P 1/207* (2006.01)
*H01P 5/18* (2006.01)

(58) Field of Classification Search
USPC ..... 333/161
See application file for complete search history.

(56) References Cited

FOREIGN PATENT DOCUMENTS

| | | |
|---|---|---|
| CN | 103050747 | 4/2013 |
| CN | 104037474 | 9/2014 |

* cited by examiner

PHASE SHIFTER OF THE CAVITY TYPE INCLUDING A FEEDING NETWORK, A SLIDEABLE DIELECTRIC ELEMENT AND A TRANSFORMATION DEVICE, WHICH ARE MOUNTED WITHIN THE CAVITY OF THE PHASE SHIFTER

CROSS-REFERENCE TO RELATED APPLICATIONS

This application is the US National Stage of International Application No. PCT/CN2015/071661, filed on Jan. 27, 2015, which claims the priority of the Jan. 28, 2014 Chinese Application No. 201410042992.4. The contents of each of the above-referenced application is incorporated herein by reference in its entirety.

FIELD OF THE INVENTION

The present invention relates to a technical field of mobile communication antennas and more particularly, relates to a phase shifter of the cavity type.

BACKGROUND OF THE INVENTION

In the field of mobile communication network coverage, an electrical tilt antenna for a base station is one of many important devices for realizing network coverage. In addition, a phase shifter is the most important component of the base station electrical tilt antenna. The quality of the phase shifter has direct influence on performance of the electrical tilt antenna, and has further influence on coverage quality of the network. As a result, it is manifest that the phase shifter plays a key role in the field of mobile base station antenna. There are two conventional means to realize phase shifting. One way is achieved by changing the electrical length of a signal path inside the phase shifter, and the other way is achieved by moving dielectric material inside the phase shifter, thus further changing transmission velocity of signal in the phase shifter, thereby continuous linear phase difference for the signal output from the shifter is being generated. As such, the phase shifting is realized.

A prior art phase shifter has the following major disadvantages.

First, design of the phase shifter cavity and transmission-line transformation device is complicated, and therefore, it is hard to manufacture the shifter by simple die-casting or extrusion process.

Secondly, to avoid resonance in the circuit of the phase shifter, more screws are provided for fastening purpose, thus resulting in low production efficiency. In addition, passive inter-modulation will be easily generated in case of a screw failure.

SUMMARY OF THE INVENTION

The object of the present invention is to provide a phase shifter of the cavity type for overcoming the disadvantages of prior art shifters, and improving electric performance, physical features and production and assembling process.

To achieve the object, the following solution is provided.

A phase shifter of the cavity type includes a cavity, a feeding network, a dielectric element, and at least one transmission-line transformation device. The cavity has several enclosing walls and a chamber defined jointly by the several enclosing walls; at least one of two ends of the cavity along its longitudinal direction is not provided with any enclosing wall to predefine an opened end. The feeding network is disposed inside the chamber. The dielectric element is disposed between the feeding network and enclosing walls, and is able to be driven to move straight along the longitudinal direction of the cavity. A mounting portion is provided on an end portion of the cavity along the longitudinal direction, or is provided on an enclosing wall on a sidewall of the cavity at a location close to the end portion of the cavity, for mounting the transmission-line transformation device. The at least one transmission-line transformation device is connected with the enclosing walls for connecting an outer conductor of a transmission cable, and for passing an inner conductor of the transmission cable into the cavity and being connected with the feeding network.

Each of the transmission-line transformation device has at least one transmission line connecting end for connecting the outer conductor of the transmission cable and a plurality of fixing posts connected with these connecting end; and the mounting portion has holding grooves for holding the fixing posts of the device in place.

At least one transmission line connecting end of the transmission-line transformation device is integrally formed with the plurality of fixing posts.

The transmission-line transformation device is secured onto the mounting portion by welding fixing posts thereof into the holding grooves. Here, the welding manner is done in an automatic or semi-automatic welding.

The feeding network is a circuit constructed of a metal conductor, and the metal conductor is held in the cavity by an insulation fastener.

The feeding network is a circuit with phase shifting function and printed on a base plate; and a holding groove is defined in each of a pair of opposed enclosing walls of the cavity for holding the base plate therein.

The phase shifter of the cavity type further includes a dielectric driving element disposed at the opened end of the cavity and coupled with the dielectric element for causing straight movement of the dielectric element along the longitudinal direction of the cavity.

The present invention has the following advantageous effect when compared to prior art:

At first, for the phase shifter of the cavity type of the present invention, the cavity and transmission-line transformation device are individually made and then are welded together by an automatic or semi-automatic welding process. Moreover, the cavity is formed by extrusion or a die-casting process. Therefore, the phase shifter of the cavity type has a simple design and is easy to be made, thus greatly reducing manufacture cost of the phase shifter and facilitating batch production.

Secondly, the phase shifter of the cavity type of present invention has small size, less weight, and low cost.

Finally, the fastening of the phase shifter of the cavity type is realized without any screws, and the device and cavity are welded with each other, thus avoiding reliability and inter-modulation problems resulted from failure of screws. Furthermore, as the transmission-line transformation device is welded with the cavity by using an automatic or semi-automatic welding process, welding quality and uniformity is maintained.

DETAILED DESCRIPTION OF THE INVENTION

Figure 1:
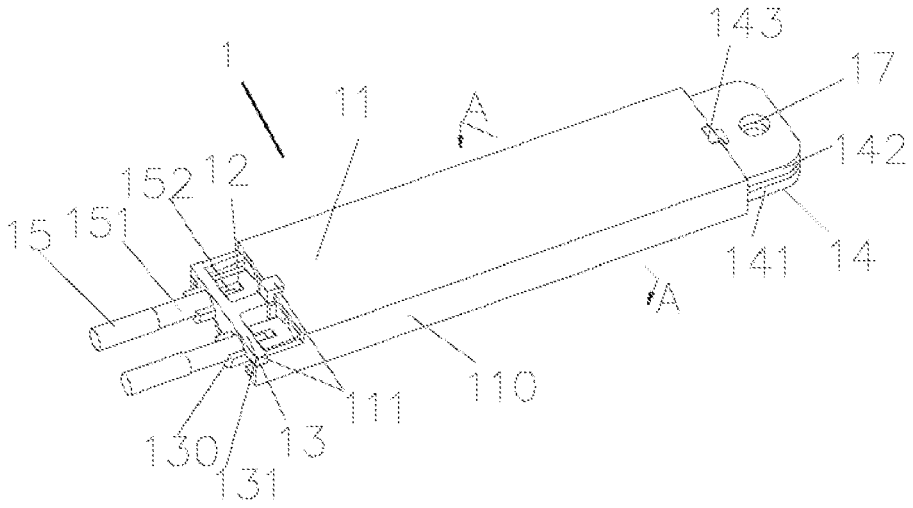
FIG. 1 shows a perspective view of a phase shifter of the cavity type according to a first embodiment of the present invention.

Various embodiments of the present invention will be described below in further detail with reference to the accompanying drawings, where identical numbers represent the identical components throughout the description. Detailed description of techniques unnecessary for illustration of features of current invention will be omitted herefrom The phase shifter of the cavity type of the present invention includes an integral cavity, a feeding network, a plurality of transmission-line transformation devices, and a dielectric element. The feeding network is disposed inside the cavity connected with the plurality of transmission-line transformation devices. The dielectric element is placed between the cavity and feeding network. To better explain structure and principles of present invention, the present invention further discloses a transmission cable assembled together with the phase shifter of the cavity type.

The cavity is integrally formed by extrusion or a die-casting process. The cavity includes multiple enclosing walls and a chamber defined by the enclosing walls for receiving the feeding network and other related components therein. Moreover, at least one of two ends along a longitudinal direction of the cavity is not provided with any enclosing wall to predefine an opened end.

Dependent upon requirements of operation known to a person of ordinary skill in the art, the cavity may be designed to include four enclosing walls longitudinally disposed and surrounding the cavity. Alternatively, the cavity may also be designed to contain five enclosing walls with above four walls longitudinally disposed and surrounding the cavity included. In other words, one of the two end surfaces along the longitudinal direction is not provided with an enclosing wall in order to predefine an opened end for mounting the feeding network and dielectric element and manipulating the same element.

The feeding network may be a circuit printed on a base plate such as a PCB and having phase shifting function. A holding groove is defined in each of a pair of opposed enclosing walls of the cavity for holding the base plate of the feeding network therein. The feeding network may also be a circuit constructed of a metal conductor based on phase shifting function. The metal conductor is secured in a chamber of the cavity by an insulation fastener.

The feeding network has an input port and an output port, both of which are referred as to "feeding port". The several feeding ports are connected with an inner conductor of a transmission cable respectively. In present invention, to facilitate connection between the feeding ports and inner conductor of the transmission cable, a plurality of operation holes may be defined in the enclosing wall at locations corresponding to these input and output ports. The number of the plurality of operation holes may be equal to or less than that of the feeding ports, and this may be determined freely by person of ordinary skill in the art.

The transmission-line transformation devices are all connected to the enclosing walls for welding an outer conductor of the transmission cable, and for passing the inner conductor of the transmission cable into the cavity and being connected with the feeding ports of the feeding network. Each transmission-line transformation device has at least one transmission line connecting end and a plurality of fixing posts connected with the connecting end. The transmission line connecting end is used for realizing connection between the outer conductor of the transmission cable and enclosing walls. The inner conductor of the transmission cable passes through the connecting end and then is connected to the feeding network. The fixing posts of the transmission-line transformation device have the function of securing the device onto the cavity. As each feeding port is coupled with an inner conductor of a transmission cable, the number of the connecting ends should be the same as that of the feeding ports of the phase shifter of the cavity type. As each feeding port is coupled with an inner conductor of a transmission cable, the number of the connecting ends should be the same as that of the feeding ports of the phase shifter of cavity type.

To facilitate in mounting of the transmission-line transformation device onto the cavity, at least one mounting portion is provided on the cavity. The mounting portion has a holding groove for holding the fixing posts of the device in place. The transmission-line transformation device is attached onto the mounting portion by welding its fixing posts into the holding groove. The at least one mounting portion is positioned on an end portion of the cavity, and/or is disposed on the enclosing wall of a sidewall of the cavity at a location close to the end portion of the cavity. The end portion of the cavity means at least one of two end surfaces of the cavity along a longitudinal direction. The end surface is a concept relative to the sidewall of the cavity.

Person of ordinary skill in the art according to requirements of wiring may freely configure the mounting portion. For example, when there is only one mounting portion, it can be disposed on one end portion of the cavity, or disposed on the enclosing wall of the sidewall of the cavity at a location close to the same end portion of the cavity. When more than one mounting portions are employed, they may be distributed in multiple enclosing walls respectively. Alternatively, the mounting portions may be disposed at the same sidewall at locations close to the two end portions of the cavity.

The dielectric element is elongated, and is disposed between the feeding network and enclosing walls. When driven, the dielectric element moves straight along the longitudinal direction of the cavity, thereby changing signal transmission speed inside the phase shifter, further changing phase of the signal, producing phase difference, and finally realizing phase shifting.

First Embodiment

Figure 2:
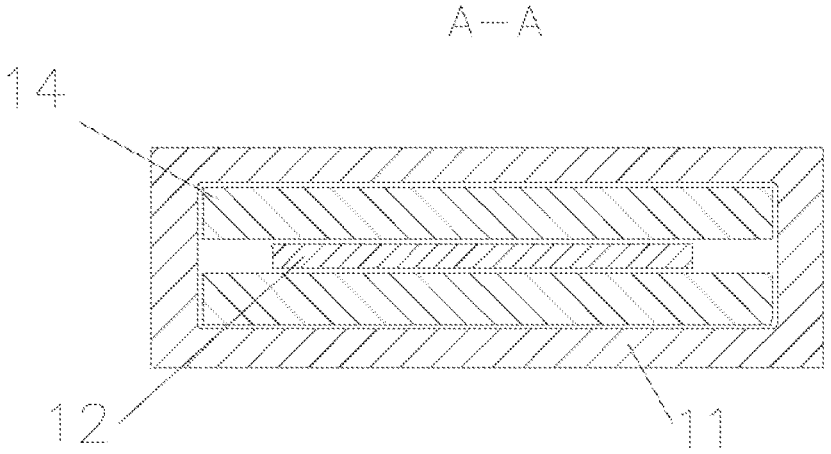
FIG. 2 shows a cross-sectional view of the phase shifter of the cavity type in FIG. 1 along line A-A.
Figure 3:
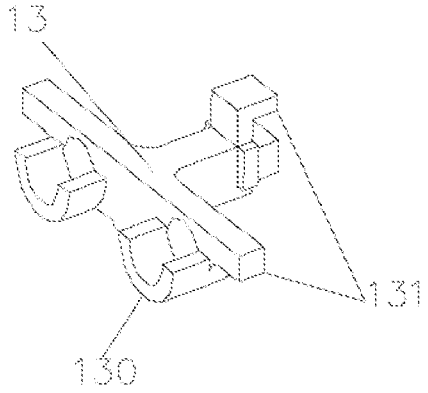
FIG. 3 shows a schematic view of a transmission-line transformation device of the phase shifter of the cavity type in FIG. 1.

Referring to FIGS. 1-3, a phase shifter of the cavity type 1 (FIG. 1) of the present invention includes a cavity 11

(FIGS. 1 and 2), a feeding network 12 (FIGS. 1 and 2), a dielectric element 14 (FIGS. 1 and 2) and a transmission-line transformation device 13 (FIGS. 1 and 3). The feeding network 12 disposed inside the cavity 11, a dielectric element 14 located between the feeding network 12 and cavity 11, and a transmission-line transformation device 13 disposed at one end of the cavity 11.

The cavity 11 is formed by extrusion or a die-casting process. The cavity 11 includes four enclosing walls 110 (FIG. 1) along the longitudinal direction thereof and a chamber (not labeled) defined by said four enclosing walls 110. Two ends of the cavity 11 are not provided with any enclosing walls 110. One of the two ends of cavity helps electrical connection between an inner conductor 152 of the transmission cable 15 and feeding network 12 as shown in FIG. 1, whereas the other end thereof helps installation of the dielectric element 14 and facilitates straight movement of the dielectric element 14 along the longitudinal direction of the cavity 11.

The feeding network 12 is a circuit formed by a metal conductor, and is secured into the cavity 11 by an insulation member (not shown). The feeding network 12 includes an input port and an output port both of which are referred as to feeding ports for being connected with an external element, thus realizing transformation and transmission of the signal. In other embodiments, the feeding network 12 may also be a circuit printed on a base plate such as a PCB (not shown) and having phase shifting function. The network 12 is mounted in the chamber by mounting the base plate into a holding groove (not shown) defined in an opposite enclosing walls of the cavity 11.

As discussed above, to realize connection of the feeding network 12 with the external element, the phase shifter of the cavity type of this embodiment further includes a transmission-line transformation device 13. The transmission-line transformation device 13 includes a pair of transmission line connection ends 130 and 3 fixing posts 131 integrally formed with the ends 130 as shown in FIGS. 1 and 3. The transmission line connection ends 130 are intended for welding outer conductors 151 (FIG. 1) of the transmission cable 15 and for passing the inner conductor 152 of the transmission cable 15 into the chamber and being connected with the feeding network 12. The three fixing posts 131 are intended for mounting the device 13 onto the cavity 11.

The transmission-line transformation device 13 of the present invention also applies in signal transmission among a coaxial cable 15 running as a transmission cable, cavity 11, and feeding network 12. Specifically, at a transmission line connection end, an outer conductor 151 of the coaxial cable 15 for inputting signals is just pressed against and welded together with the transmission line connection end 130 of the transmission-line transformation device 13 of the phase shifter of the cavity type 1 of the present invention. An inner conductor 152 of the coaxial cable 15 is coupled with the feeding port of the feeding network 12 of the phase shifter 1. The insulation material sandwiched between the outer conductor 151 and inner conductor 152 of the coaxial cable 15 insulates the feeding network 12 from the enclosing walls 110 of the cavity 11.

To assist in mounting of the transmission-line transformation device 13 onto the cavity 11, a mounting portion (not labeled) is provided on the cavity 11 at one end thereof for mounting the transmission-line transformation device 13 thereon. The mounting portion has, at locations corresponding to the fixing posts 131, a plurality of holding grooves 111 (FIG. 1) for holding the fixing posts 131 of the transmission-line transformation device 13 in place. In assembly, the fixing posts 131 of the transmission-line transformation device 13 are restricted into the holding grooves 111 of the cavity 11, and then they are welded together. Further, this welding is preferably full-automatic or semi-automatic to maintain quality and uniformity of the welding process.

As mentioned above, the dielectric element 14 is located between the enclosing wall 110 and feeding network 12. In addition, the dielectric element 14 extends from one end, at which the transmission-line transformation device 13 locates, of the cavity 11, to the other end and then out of the cavity 11. To obtain higher equivalent dielectric coefficient as shown in FIG. 1, the dielectric element 14 includes an upper dielectric element 142 and a lower dielectric element 141 disposed over and below the feeding network 12 respectively such that the space within the chamber is filled by the dielectric element 14 to the largest extent. Moreover, the dielectric element 14 employs material with dielectric coefficient $\varepsilon_r>1.0$. In addition, one or more materials may be used for making the element. In addition to achieve higher dielectric coefficient, the material is further required to have low loss angle tangent characteristics.

When driven, the dielectric element 14 moves straight along the longitudinal direction of the cavity 11, thereby changing signal transmission speed inside the phase shifter 1, thus further changing phase of the signal, producing phase difference, and finally realizing phase shifting.

To facilitate straight movement of the dielectric element 14 inside the cavity, the phase shifter of the cavity type 1 further includes a dielectric driving element 17 coupled with the dielectric element 14. The dielectric driving element 17 (FIG. 1) is disposed on the cavity 11 at one end opposite to the other end on which the mounting portion (not labeled) is formed. To maintain synchronous movement of the upper dielectric element 142 and lower dielectric element 141, the dielectric element 14 further includes a dielectric element connection member 143 (FIG. 1) for connecting the upper dielectric element 142 and the lower dielectric element 141 together.

It may be understood by persons of the art that some features of this embodiment might be applied to other embodiments. For example, features regarding material and structure of dielectric element may be employed in a second embodiment. The feeding network may be constructed of metal conductor, or circuit printed on a base plate for realizing specific circuit function. In addition, manner by which the feeding network is secured into the cavity may also be applied to various embodiments of the present invention. Please note that in following embodiments, a certain structure perhaps will not be described and it should not be understood that the phase shifter of the present invention lacks of this certain structure. Moreover, some structures in following embodiments may also be applied to present embodiment. In other words, the phase shifter of the cavity type of present invention may be configured with flexibility by person of ordinary skill in the art.

Second Embodiment

Figure 4:
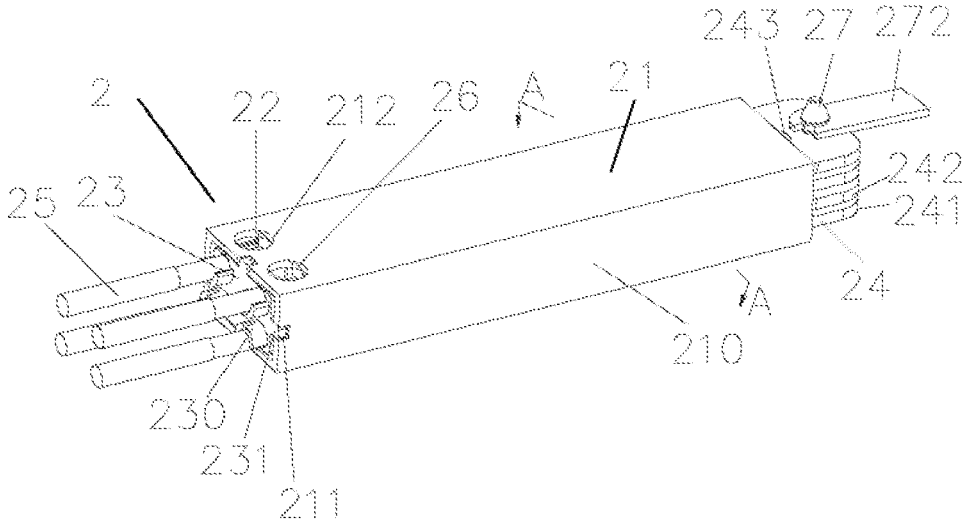
FIG. 4 shows a perspective view of a phase shifter of the cavity type according to another embodiment of the present invention.
Figure 5:
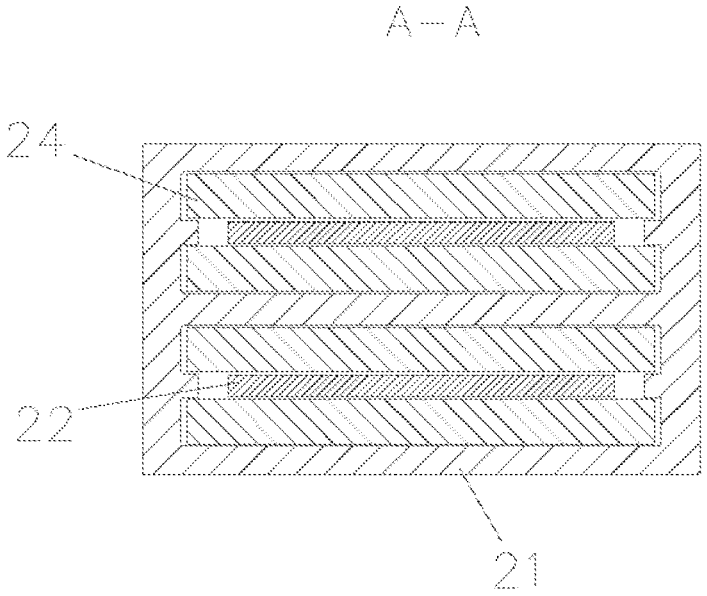
FIG. 5 shows a cross-sectional view of the phase shifter of the cavity type in FIG. 4 along line A-A.
Figure 6:
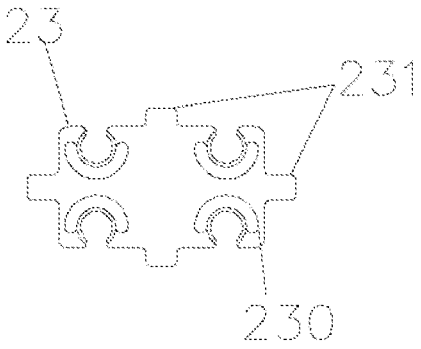
FIG. 6 shows a schematic view of a transmission-line transformation device of the phase shifter of the cavity type in FIG. 4.

Referring to FIGS. 4-6. The phase shifter of the cavity type 2 (FIG. 4) of present invention is a combinative phase shifter made by 2 phase shifters which are juxtaposed up and down and share a cavity 21 (FIGS. 4 and 5). This kind of combinative phase shifter may be applied to a mobile communication antenna of single frequency and dual polarization.

The cavity 21 is made by extrusion or a die-casting process. The cavity 21 has an upper chamber and a lower chamber (not labeled) both of which run along a longitudinal direction of the cavity 21. The chambers (not labeled) are used for mounting the feeding network 22, dielectric element 24, and other components as shown in FIG. 4.

Several operation holes 212 are defined in the cavity 21 for convenient connection between an inner conductor of the transmission cable 25 and feeding ports of the feeding network 22 as shown in FIG. 4. The number of the operation holes 212 may be mostly equal to that of the feeding ports of the feeding network 22, i.e., the number of the operation holes 212 may be no more than that of the feeding ports, and, this may be determined freely by person of ordinary skill in the art.

A mounting portion (not labeled) is provided on the cavity 21 at one end thereof. The transmission-line transformation device 23 is positioned on the mounting portion. The transmission-line transformation device 23 (FIGS. 4 and 6) has a plurality of fixing posts 231 (FIGS. 4 and 6), and the mounting portion has a plurality of holding grooves 211 for holding the fixing posts 231 therein. The fixing posts 231 and holding grooves 211 FIG. 4 are of the same quantity. In assembly, the fixing posts 231 of the transmission-line transformation device 23 are restricted into the holding grooves 211 of the cavity 21, and then they are welded together. Further, this welding is preferably full-automatic or semi-automatic to maintain quality and uniformity of the welding process.

Each chamber of the phase shifter of the cavity type of the present invention is provided with a feeding network 22, which is secured into a corresponding cavity 21 by an insulation fastener 26 as shown in FIG. 4.

According to a preferred embodiment of the present invention, the transmission-line transformation device 23 also applies in connection among a coaxial cable 25, the cavity 21, and feeding network 22 for realizing signal transformation and transmission. Specifically, at a transmission line connection end, an outer conductor of the coaxial cable 25 for inputting signals is just pressed against and connected together with the transmission line connection end 230 (FIGS. 4 and 6) of the transmission-line transformation device 23 of the phase shifter of the cavity type 2 of the present invention. An inner conductor of the coaxial cable 25 is coupled with the feeding port 22 of the phase shifter 2. The insulation material sandwiched between the outer conductor and inner conductor of the coaxial cable 25 insulates the feeding network 22 from the cavity 21.

Within each chamber of the phase shifter of the cavity type of the present invention, a dielectric element 24 is disposed between the enclosing wall 210 (FIG. 4) of the cavity 21 and feeding network 22. Moreover, to obtain higher equivalent dielectric coefficient, the dielectric element 24 includes an upper dielectric element 242 and a lower dielectric element 241 as shown in FIG. 4.

When driven, the dielectric element 24 moves straight along the longitudinal direction of the cavity 21, thereby changing signal transmission speed inside the phase shifter 2, thus further changing phase of the signal, producing phase difference, and finally realizing phase shifting. In addition, this phase change occurs linearly and gradually.

To maintain synchronous movement of the upper dielectric element 242 and lower dielectric element 241, the dielectric element 24 further includes a dielectric element connection member 243 (FIG. 4) for connecting the upper dielectric element 242 and the lower dielectric element 241 together.

Furthermore, for conveniently operating the dielectric element 24, the phase shifter of the cavity type 2 further includes a dielectric driving element 27, which has an accessory 272 for connecting with external devices such as motors as shown in FIG. 4, in order that the dielectric element 24 is able to move straight along the longitudinal direction of the cavity 21 when driven by an external device such as a motor.

It may be understood by persons of the art from the present embodiment that multiple chambers may be formed in the cavity 21 of the phase shifter of the present invention. These chambers may be juxtaposed up and down or side by side. In addition, these chambers may be placed the same feeding networks therein so that the phase shifter will be suited for a single frequency antenna. Alternatively, different feeding networks 22 may be placed in these chambers such that the phase shifter 2 is suited for a multiple frequency antenna.

Third Embodiment

Figure 7:
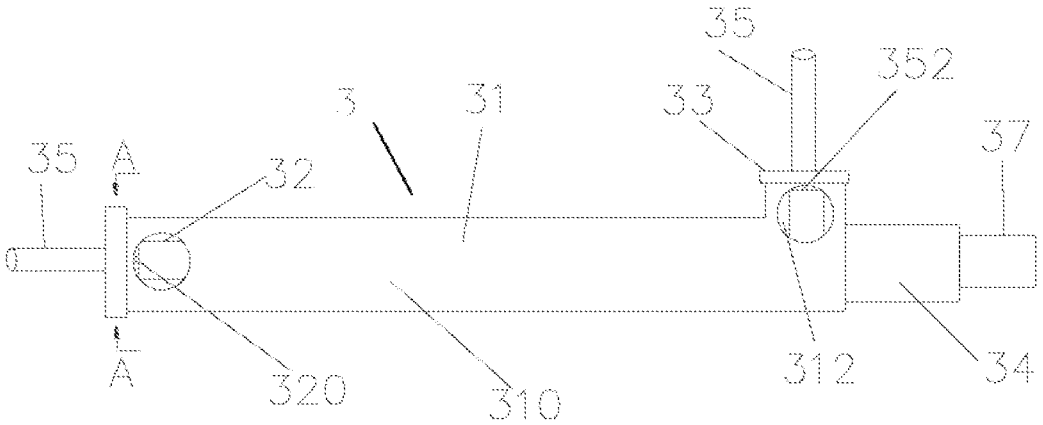
FIG. 7 shows a perspective view of a phase shifter of the cavity type according to a further embodiment of the present invention.
Figure 8:
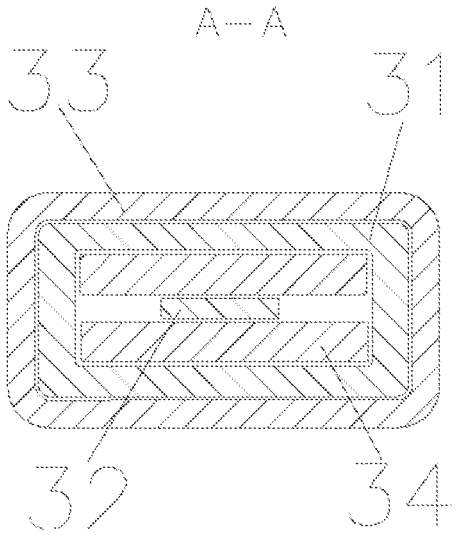
FIG. 8 shows a cross-sectional view of the phase shifter of the cavity type in FIG. 7 along line A-A.
Figure 9:
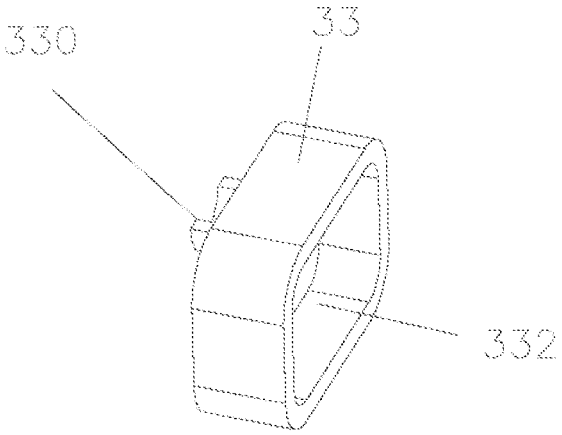
FIG. 9 shows a schematic view of a transmission-line transformation device of the phase shifter of the cavity type in FIG. 7.

Refer to FIGS. 7-9. In present embodiment, a feeding network 32 (FIGS. 7 and 8) is substantially of an L shape. Two ends of the feeding network are mounted inside the cavity 31 (FIGS. 7 and 8) by an insulation fastener (not shown). Corresponding to this change, each end of the cavity 31 is provided with a mounting portion (not labeled). Each mounting portion is provided with a transmission-line transformation device 33. Here, one mounting portion is disposed at one end along the longitudinal direction of the phase shifter 3 (FIG. 7), while the other mounting portion is disposed at a side of the shifter 3 close to the other end thereof, such that the dielectric element 34 (FIGS. 7 and 8) will be able to slide without obstacle of the insulation fastener and coaxial cable 35 (FIG. 7).

A through hole 332 (FIG. 9) is defined in a respective transmission-line transformation device 33. The diameter of the hole 332 (FIG. 9) is larger than size of the axial section of the cavity 31. By this manner, the cavity 31 is able to be inserted into the through hole 332. Preferably, after insertion of the cavity 31 into the through hole 332, they are connected together by full-automatic or semi-automatic welding.

The transmission-line transformation device 33 further includes a transmission line connection end 330 (FIG. 9) connected with an outer conductor of a coaxial cable 35. An inner conductor 352 of the cable 35 is connected with a feeding port 320 of the feeding network 32 of the phase shifter 3 as shown in FIG. 7. The insulation material sandwiched between the outer conductor and inner conductor 352 (FIG. 7) of the coaxial cable 35 insulates the feeding network 32 from the cavity 31 of the phase shifter 3, thus realizing power feeding.

Corresponding to the feeding port 320 of the feeding network 32, an operation hole 312 is defined in an enclosing wall 310 of the cavity 31 as shown in FIG. 7, so that the inner conductor 352 of the coaxial cable 35 will be readily electrically connected with the feeding port 320 of the feeding network 32 of the phase shifter 3.

The dielectric element 34 is disposed between the enclosing wall 310 of the cavity 31 and feeding network 33, so that when driven, the dielectric element 34 moves straight along the longitudinal direction of the cavity 31, thereby changing signal transmission speed inside the phase shifter 3, thus further changing phase of the signal, producing phase difference, and finally realizing phase shifting.

To facilitate operation of the dielectric element 34, the phase shifter of the cavity type of the present invention further includes a dielectric driving element 37 (FIG. 7)

coupled with the dielectric element 34. Movement of the dielectric element 34 inside the cavity 31 is realized by an external device such as a motor.

In a summary, according to the phase shifter of the cavity type of the present invention, the phase shifter is divided into two components: one is a cavity, and, the other is a transmission-line transformation device, and then the two components are welded together. This greatly reduces process complexity of the phase shifter. As a result, the fastening of the phase shifter of the cavity type of the present invention may be realized without any screws, thus avoiding reliability and inter-modulation problems resulted from failure of screws. Electrical and physical characteristics of the phase shifter are also significantly improved. The phase shifter of the cavity type of the present invention is a fundamental component and has optimistic prospects of application.

Though various embodiments of the present invention have been illustrated above, a person of ordinary skill in the art will understand that, variations and improvements made upon the illustrative embodiments fall within the scope of the present invention, and the scope of the present invention is only limited by the accompanying claims and their equivalents.

The invention claimed is:

1. A phase shifter of the cavity type, comprising: a cavity, a feeding network, a dielectric element, and at least one transmission-line transformation device;

the cavity has multiple enclosing walls and a chamber defined by the multiple enclosing walls; at least one of two ends along a longitudinal direction of the cavity which is not provided with any enclosing wall so as to predefine an opened end;

the feeding network is disposed inside the chamber;

the dielectric element is disposed between the feeding network and the multiple enclosing walls, and is able to make straight movement along the longitudinal direction of the cavity by a force;

a mounting portion is provided on one of the two ends of the cavity along the longitudinal direction, or is provided on one of the multiple enclosing walls, the one of the multiple enclosing walls is defined on a sidewall of the cavity at a location close to the one of the two ends of the cavity, for mounting the transmission-line transformation device;

the at least one transmission-line transformation device is connected with at least three of the multiple enclosing walls for connecting an outer conductor of a transmission cable, and for passing an inner conductor of the transmission cable into the cavity and being connected with the feeding network;

wherein each of the at least one transmission-line transformation device has at least one transmission line connecting end for connecting the outer conductor of the transmission cable and a plurality of fixing posts connected with the at least one transmission line connecting end; and the mounting portion has a plurality of holding grooves for holding in place the respective plurality of fixing posts of the at least one transmission-line transformation device.

2. The phase shifter of the cavity type according to claim 1, wherein the at least one transmission line connecting end of the transmission-line transformation device is integrally formed with the plurality of fixing posts.

3. The phase shifter of the cavity type according to claim 2, wherein the at least one transmission-line transformation device is secured onto the mounting portion by welding the plurality of fixing posts into the plurality of holding grooves.

4. The phase shifter of the cavity type according to claim 1, wherein the at least one transmission-line transformation device is secured onto the mounting portion by welding the plurality of fixing posts into the plurality of holding grooves.

5. The phase shifter of the cavity type according to claim 1, wherein the feeding network is a circuit constructed of a metal conductor, and the metal conductor is held in the cavity by an insulation fastener.

6. The phase shifter of the cavity type according to claim 1, wherein the feeding network is a circuit with phase shifting function and printed on a base plate.

7. The phase shifter of the cavity type according to claim 1, further comprising a dielectric driving element disposed at the opened end of the cavity and coupled with the dielectric element for causing straight movement of the dielectric element along the longitudinal direction of the cavity.

* * * * *